US011495881B1

(12) United States Patent
Harvey et al.

(10) Patent No.: US 11,495,881 B1
(45) Date of Patent: Nov. 8, 2022

(54) ANTENNA SYSTEM WITH INTEGRATED ELECTROMAGNETIC INTERFERENCE SHIELDED HEAT SINK

(71) Applicant: Ball Aerospace & Technologies Corp., Boulder, CO (US)

(72) Inventors: Jeremy Harvey, Boulder, CO (US); Kevin Weed, Superior, CO (US); Bevan D. Staple, Longmont, CO (US)

(73) Assignee: Ball Aerospace & Technologies Corp., Boulder, CO (US)

( * ) Notice: Subject to any disclaimer, the term of this patent is extended or adjusted under 35 U.S.C. 154(b) by 0 days.

(21) Appl. No.: 16/707,725

(22) Filed: Dec. 9, 2019

Related U.S. Application Data

(60) Provisional application No. 62/777,579, filed on Dec. 10, 2018.

(51) Int. Cl.
*H01Q 1/52* (2006.01)
*H01Q 1/00* (2006.01)
*H01Q 3/30* (2006.01)

(52) U.S. Cl.
CPC ..... *H01Q 1/526* (2013.01); *H01Q 1/002* (2013.01); *H01Q 3/30* (2013.01)

(58) Field of Classification Search
CPC ..... H01Q 1/526; H01Q 3/30; H01Q 1/002
See application file for complete search history.

(56) References Cited

U.S. PATENT DOCUMENTS 5,309,319 A * 5/1994 Messina ..... H01L 23/4338 165/142
2003/0230400 A1 12/2003 McCordic et al.
2005/0219137 A1 10/2005 Heisen et al.
2006/0119512 A1* 6/2006 Yoshimatsu ..... H01L 25/112 342/372
2007/0152882 A1 7/2007 Hash et al.
2008/0106482 A1 5/2008 Cherrette et al.
2008/0150832 A1 6/2008 Ingram et al.
2009/0273517 A1 11/2009 Thiesen et al.
2009/0284415 A1 11/2009 Worl et al.
2010/0164783 A1 7/2010 Choudhury et al.
2010/0327068 A1 12/2010 Chen et al.
2011/0068993 A1 3/2011 Worl et al.
2011/0148707 A1 6/2011 Thiesen et al.
2012/0139786 A1 6/2012 Puzella et al.
2012/0268344 A1 10/2012 McCarthy
2013/0050055 A1 2/2013 Paradiso et al.
(Continued)

FOREIGN PATENT DOCUMENTS

JP 2009159430 A * 7/2009

*Primary Examiner* — Andrea Lindgren Baltzell
*Assistant Examiner* — Yonchan J Kim
(74) *Attorney, Agent, or Firm* — Sheridan Ross P.C.

(57) ABSTRACT

An antenna system with integrated electromagnetic interference (EMI) shielded heat sink is disclosed. The system includes an antenna circuit board with a plurality of antenna or radiating elements formed on a common plane comprising a first surface. Circuit elements are placed on a second surface of the antenna circuit board. In addition, the second surface of the antenna circuits board is connected to a pocketed EMI shielding cover with individual shield pockets serving as an EMI shield and a heat sink containing a cooling fluid. At least some adjacent pockets can be in fluid communication with one another.

19 Claims, 9 Drawing Sheets

(56) References Cited

U.S. PATENT DOCUMENTS

| | | | | |
|---|---|---|---|---|
| 2013/0194134 | A1 | 8/2013 | Beeker et al. | |
| 2015/0303560 | A1 | 10/2015 | Ahn et al. | |
| 2016/0226141 | A1 | 8/2016 | Lee | |
| 2016/0276743 | A1 | 9/2016 | Runyon et al. | |
| 2017/0054208 | A1 | 2/2017 | Pietila et al. | |
| 2017/0215089 | A1 | 7/2017 | Lipowski et al. | |
| 2017/0215090 | A1 | 7/2017 | Lipowski et al. | |
| 2017/0215210 | A1 | 7/2017 | Lipowski et al. | |
| 2017/0331176 | A1 | 11/2017 | Levy et al. | |
| 2017/0331437 | A1 | 11/2017 | Ahn et al. | |
| 2018/0011180 | A1 | 1/2018 | Warnick et al. | |
| 2018/0038977 | A1 | 2/2018 | Caute et al. | |
| 2018/0083352 | A1 | 3/2018 | Eshaghi et al. | |
| 2018/0115066 | A1 | 4/2018 | Jain et al. | |
| 2018/0115356 | A1 | 4/2018 | Jain et al. | |
| 2018/0175501 | A1 | 6/2018 | Byun et al. | |
| 2018/0246200 | A1 | 8/2018 | Goossen et al. | |
| 2018/0310436 | A1* | 10/2018 | Egami | F28F 13/08 |
| 2018/0372693 | A1 | 12/2018 | Spay et al. | |
| 2019/0109101 | A1 | 4/2019 | Menon et al. | |
| 2019/0131706 | A1 | 5/2019 | Raney et al. | |
| 2019/0260109 | A1 | 8/2019 | Gu et al. | |
| 2019/0260138 | A1 | 8/2019 | Gu et al. | |
| 2019/0267716 | A1 | 8/2019 | Yoon et al. | |
| 2019/0267721 | A1 | 8/2019 | Yoon et al. | |
| 2019/0267722 | A1 | 8/2019 | Yoon et al. | |
| 2020/0052404 | A1* | 2/2020 | Eid | H01L 23/49541 |

* cited by examiner

ANTENNA SYSTEM WITH INTEGRATED ELECTROMAGNETIC INTERFERENCE SHIELDED HEAT SINK

CROSS-REFERENCE TO RELATED APPLICATIONS

This application claims the benefit of U.S. Provisional Patent Application Ser. No. 62/777,579, filed Dec. 10, 2018, the entire disclosure of which is hereby incorporated herein by reference.

FIELD

Embodiments of the present disclosure are directed to an antenna system with a combined pocketed electromagnetic interference shielding cover and heat sink containing a dielectric and cooling fluid.

BACKGROUND

Phased array antenna systems have a variety of applications in present day communications and surveillance systems. For example, phased array antenna systems can be used in high performance wireless communications networks, such as Multi Input Multi Output (MIMO) antenna arrays associated with fifth generation 5G cellular communications systems. As another example, phased array antenna systems can be used in RADAR surveillance and tracking systems. In such applications, the beam pattern produced by the antenna is often dynamically steered. It is desirable to locate the electronic componentry required for steering the antenna beam and for amplifying transmitted or received signals in close proximity to the elements of the antenna. However, high power levels and increases in the density of the electrical circuit designs due to the close packaging of circuit elements and the inclusion of steering or other circuitry increase the potential for interference between different circuit elements due to coupling, and increase the amount of heat generated per unit area. Accordingly, contemporary antenna systems operating in association with high frequency, high power systems, need a way to remove heat from the systems in order to ensure reliable operation. In addition, there is a need to control electromagnetic interference (EMI) from external high frequency electrical signal interference and from neighboring elements and associated electronics of the antenna itself.

A common way of shielding circuits operating at radio frequencies for EMI mitigation purposes is with a metallic hat or cover. For a large array of components, such as a phased array or an active electronically scanned array (AESA) application, the EMI cover can be provided as a plate with a number of individual pockets, one for the electrical components associated with each antenna element, for isolation. However, such arrangements can result in inadequate cooling for the circuit elements contained within the pockets. In order to provide cooling for heat generating electronic components, various cooling systems have been devised. For instance, thermosiphon or heat pipe arrangements in which a cooling fluid is circulated through cooling channels routed across or near the electronic components have been developed. However, these cooling systems have been provided separately from the EMI elements. Accordingly, providing both EMI shielding and cooling in various electronic systems, including radio frequency systems, has been complicated and relatively expensive. In addition, the ability of such systems to provide effective EMI shielding and thermal management has been less than desired.

SUMMARY

Embodiments of the present disclosure are directed to methods and systems for providing electronic systems, such as but not limited to multiple element antenna systems, with integrated EMI shielding and thermal management components. More particularly, embodiments of the present disclosure provide an electromagnetic interference shielded heat sink with a cooling fluid contained within shielded pockets or volumes to provide for adequate cooling of shielded electrical components. The cooling fluid can be contained entirely within individual EMI shield pockets or volumes, where one EMI shield pocket is provided for electronic components or circuit elements associated with each antenna element. In accordance with further embodiments, fluid flow paths can be established between pockets of adjacent antenna elements. In accordance with still other embodiments of the present disclosure, the fluid can be circulated to a radiator or other cooling component, in addition to being circulated through one or more pocket volumes.

Systems in accordance with embodiments of the present disclosure include an antenna system having a plurality of antenna or radiating elements formed on a common plane comprising a first surface of an antenna circuit board. Circuit elements (e.g., for beam shaping, power, or signal processing) are placed on a second surface of the antenna circuit board. In general, one circuit element or set of circuit elements is provided for each antenna element. The circuit elements can include integrated circuits, discrete circuit elements, or the like. In addition, the second surface of the antenna circuit board is connected to a pocketed EMI shielded heat sink. The EMI shielded heat sink includes a cover surface and shield walls that define EMI shield pockets, with one EMI shield pocket formed for the circuit elements of each antenna element. Ends of the shield walls opposite the cover surface are joined to the second surface of the antenna circuit board, forming shielded volumes containing the circuit elements. A cooling fluid is placed in the shielded volume, promoting the removal of heat from the circuit elements. In accordance with at least some embodiments of the present disclosure, adjacent shielded volumes are connected to one another by channels or passages formed in the shield walls, thereby allowing the cooling fluid to flow between different shielded volumes. In accordance with still other embodiments of the present disclosure, the cooling fluid can be circulated through a radiator or other cooling apparatus, in addition to through one or more shielded volumes.

Methods in accordance with embodiments of the present disclosure include providing an array antenna having antenna elements on one side of a substrate, and circuit elements on an opposite side of the substrate. More particularly, the antenna can be configured as a planar array, with antenna elements arranged in one or more rows and columns. In addition, the circuit elements can generally be provided in sets, with one set of circuit elements for each of the antenna elements. The method further includes providing a pocketed EMI shielded heat sink, with a planar shield surface, and walls sized to define pockets capable of containing the circuit element sets for each of the antenna elements formed on an interior side of the planar shield surface. According to the method, the pockets are filled with a cooling fluid. The ends of the walls of the pocketed EMI shielded heat sink are then joined to the second side of the circuit board, sealing the fluid in the volumes defined by the pockets. The cooling fluid can entirely fill the pockets. Alternatively, the cooling fluid can partially fill the pockets, leaving a head space in which vapor can collect after the EMI shielded heat sink is joined to the circuit board. In accordance with at least some embodiments of the present disclosure, flow channels or paths are formed between adjacent pockets, allowing cooling fluid to flow between the different pockets. The flow can be induced by an external system, such as a pump, or can be induced by convection currents. Where channels are formed, such channels can interconnect all of the volumes defined by the pockets, or subsets of the volumes.

Additional features and advantages of embodiments of the present disclosure will become more readily apparent from the following description, particularly when taken together with the accompanying drawings.

DETAILED DESCRIPTION

Figure 1:
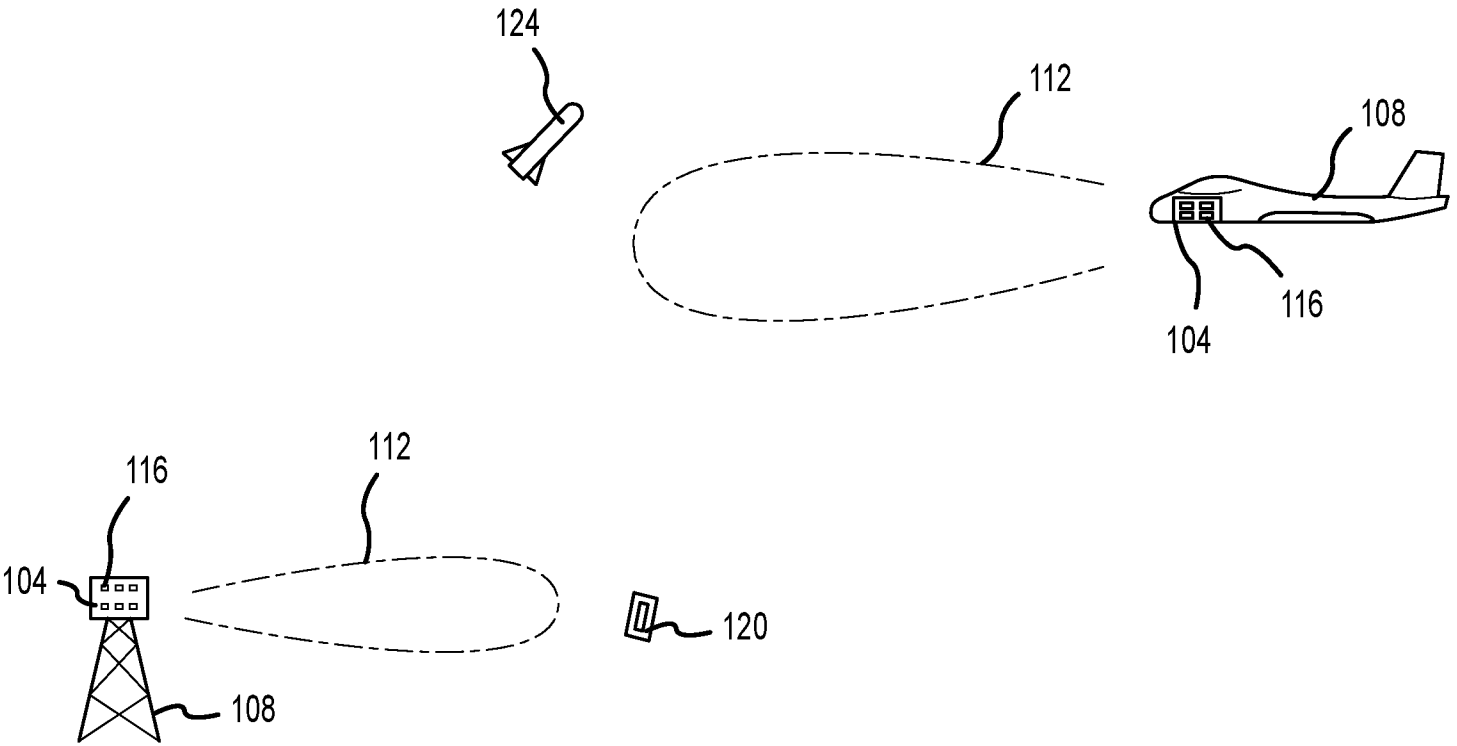
FIG. 1 depicts antenna systems incorporating an electromagnetic interference shielded heat sink in accordance with embodiments of the present disclosure in example operational scenarios.

FIG. 1 depicts antenna systems 104 incorporating an electromagnetic interference shielded heat sink mounted to platforms 108 in example operating scenarios. An antenna system 104 in accordance with embodiments of the present disclosure can generally be operated to generate a beam 112 that can be electronically or mechanically steered. As discussed in greater detail elsewhere herein, the antenna system 104 can include a planar phased array antenna system having a plurality of antenna elements 116. The platform 108 can be any platform to which an antenna system 104 can be carried or otherwise interconnected, including but not limited to a satellite, a spacecraft, an orbiter, a lander, a missile, an aircraft, an unmanned aerial vehicle, a balloon, a stratospheric balloon, a terrestrial vehicle, a ship, a tower, a building, or any other platform or device. As can be appreciated by one of skill in the art after consideration of the present disclosure, the antenna system 104 can be operated as part of a communication system, such as a 5G or other cellular communication system, or a surveillance system, such as a radar system. Where the antenna system 104 is provided in connection with a communication system, the beam 112 can be directed such that it points towards or encompasses a communication device 120, such as a mobile telephone, or some other communication node, such as a base station. Where the antenna system 104 is provided in connection with a surveillance system, the beam 112 can be directed toward a target volume to determine whether a target 124 is present within the volume, or to track the location of a target 124.

Figure 2:
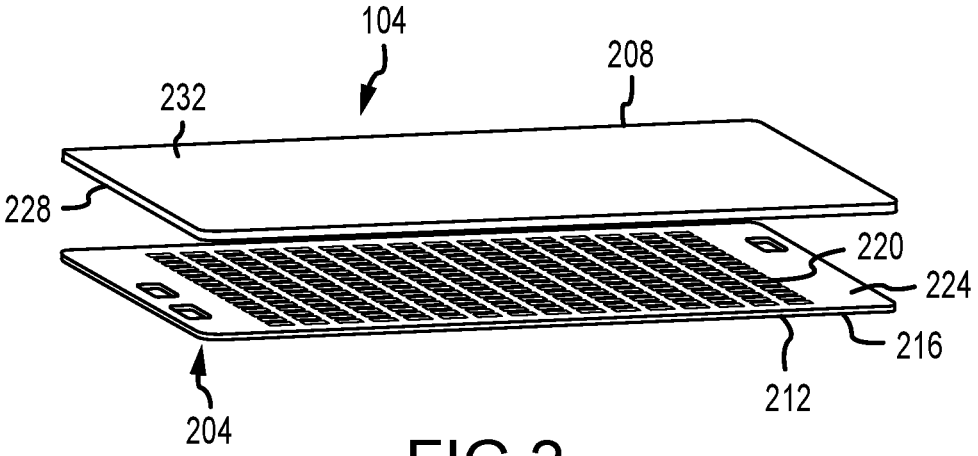
FIG. 2 is a perspective, exploded view of an antenna system incorporating an electromagnetic interference shielded heat sink in accordance with embodiments of the present disclosure.

FIG. 2 is an exploded perspective view of an antenna system 104 incorporating an antenna board 204 and an electromagnetic interference (EMI) shielded heat sink 208 in accordance with embodiments of the present disclosure. In general, the antenna board 204 includes a substrate 212, such as a multilayer circuit board or printed circuit board. The antenna elements 116 (not visible in FIG. 2) are formed on a first side or surface 216 of the substrate 212. Circuit elements 220 are placed on the second side or surface 224 of the substrate 212. In accordance with the least some embodiments of the present disclosure, one circuit element or set of circuit elements 220 is provided for each antenna element 116 of the antenna system 104. In accordance with embodiments of the present disclosure, the circuit elements 220 can include, but are not limited to amplifiers, phase shifters, signal lines, or other active or passive electrical components. Interconnections between the antenna elements 116 and their respective circuit element or elements 220 are formed in or provided by the substrate 212.

Figure 3:
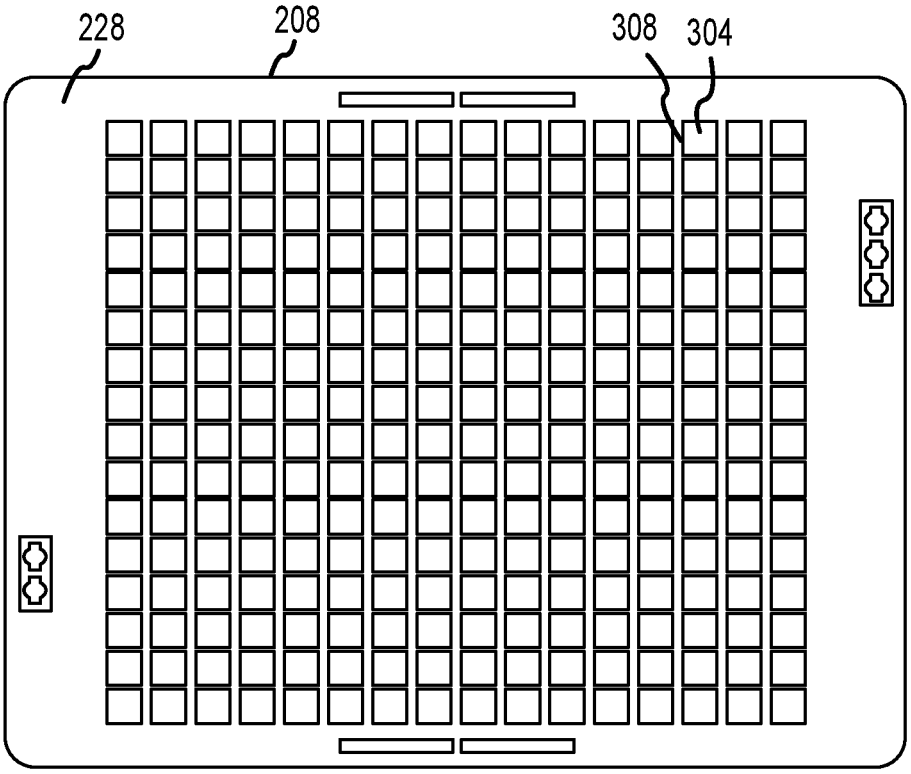
FIG. 3 is a plan view of an electromagnetic interference shielded heat sink in accordance with embodiments of the present disclosure.

The EMI shielded heat sink 208 includes an interior surface 228 that is joined to the second surface 224 of the antenna board 204 substrate 212 and a top or shield portion 232. As shown in FIG. 3, which illustrates the interior surface 228 of the EMI shielded heat sink 208 in plan view, a plurality of pockets 304, defined by walls 308, are located on the interior surface 228 side of the EMI shielded heat sink 208. The pockets 304 are disposed in rows and columns corresponding to circuit elements 220 that are themselves provided for rows and columns of antenna elements 116. In general, each of the pockets 304 is sized so as to create a volume in which the circuit element or elements 220 associated with a single antenna element 116 can be contained when the second surface 224 of the antenna board 204 and the interior surface 228 of the EMI shielded heat sink 208 are joined to one another.

Figure 4:
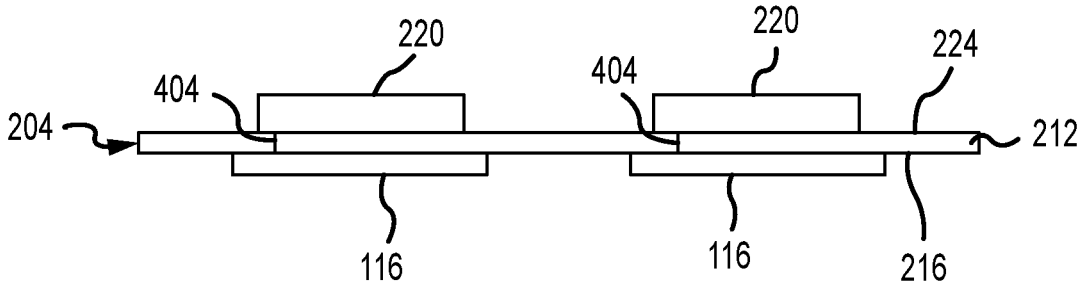
FIG. 4 is a cross-section in elevation of a portion of an antenna board and associated components in accordance with embodiments of the present disclosure.

FIG. 4 is a cross-section in elevation of a portion of an antenna board 208 in accordance with embodiments of the present disclosure. As shown, a plurality of antenna elements 116 are joined to or formed on the first side 216 of the substrate 212 of the antenna board 204. In accordance with at least some embodiments of the present disclosure, each antenna element 116 is a conductive patch. Moreover, each antenna element 116 can be square, rectangular, circular, or any other shape in a plan view. As can be appreciated by one of skill in the art after consideration of the present disclosure, the antenna elements 116 are sized according to the intended operating frequency or frequencies of the antenna system 104. Moreover, the spacing between elements can be selected based on various considerations, including the desired beam 112 parameters. One or more circuit elements 220 are joined to or formed on the second side 224 of the substrate 212 of the antenna board 204. The circuit element or elements 220 associated with a particular antenna element 116 can be placed in an area of the second side 224 of the substrate 212 directly opposite to the area of the first side 216 of the substrate 212 in which that antenna element 116 is located. Each antenna element 116 is connected to the corresponding circuit element or elements 220 by a via or other connecting structure 404.

Figure 5A:
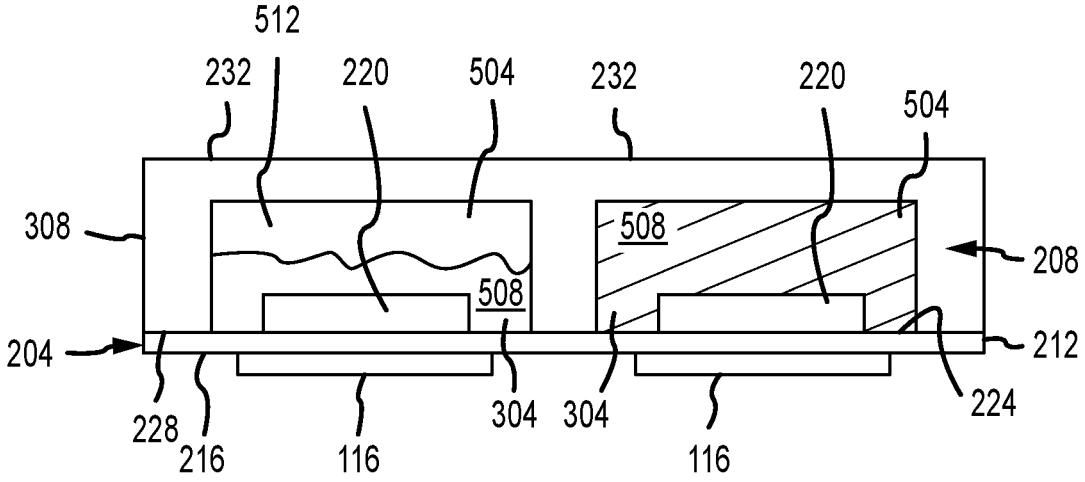
FIG. 5A is a cross-section in elevation of a portion of an antenna system incorporating an electromagnetic interference shielded heat sink in accordance with embodiments of the present disclosure.

FIG. 5A is a cross-section in elevation of a portion of an antenna system 104 incorporating an EMI shielded heat sink 208 in accordance with embodiments of the present disclosure. As shown, with the interior surface 228 of the EMI shielded heat sink 208 joined to the second surface 224 of the antenna board 204 substrate 212, the pockets 304 of the EMI shielded heat sink 208 define volumes 504 that contain the circuit element or elements 220. Moreover, one volume 504 containing one circuit element or set of circuit elements 220 is provided for each antenna element 116. In accordance with embodiments of the present disclosure, each volume 504 contains a cooling fluid 508. As depicted in the right-hand volume 504 in the figure, the cooling fluid 508 can fill the volume 504 in its entirety, such that the cooling fluid 508 is in contact with surfaces of the circuit element 220 and the surrounding pocket 304. Moreover, the fluid 508 can be pressurized, to inhibit boiling during operation of the antenna system 104. Alternatively, as depicted in the left-hand volume 504 in the figure, the cooling fluid 508 may partially fill the volume 504, leaving a head space 512 above the liquid cooling fluid 508 in which a vapor can collect. The top or shield portion 232 of the EMI shielded heat sink 208 can include cooling fins or other structures to promote the transfer of heat from the antenna system 104 to the ambient environment. In accordance with embodiments of the present disclosure, the cooling fluid 508 can include a dielectric fluid.

Figure 5B:
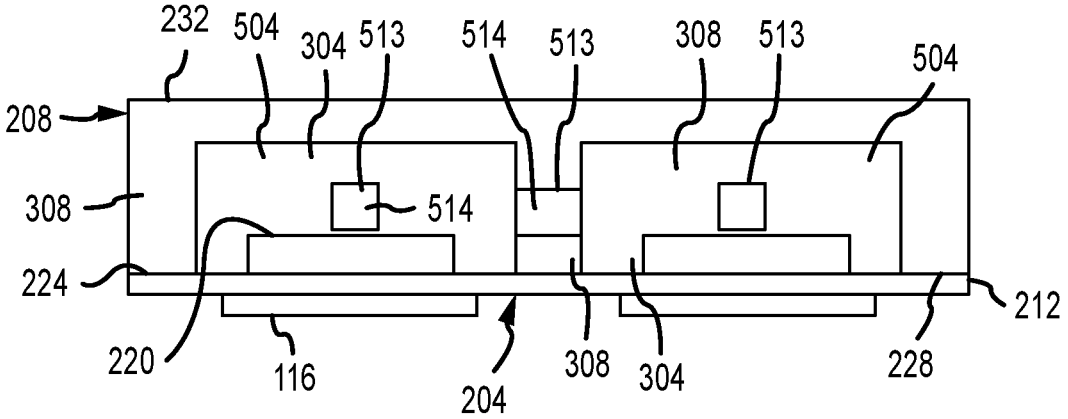
FIG. 5B is a cross-section in elevation of a portion of an antenna system incorporating an electromagnetic interference shielded heat sink in accordance with other embodiments of the present disclosure.
Figure 5C:
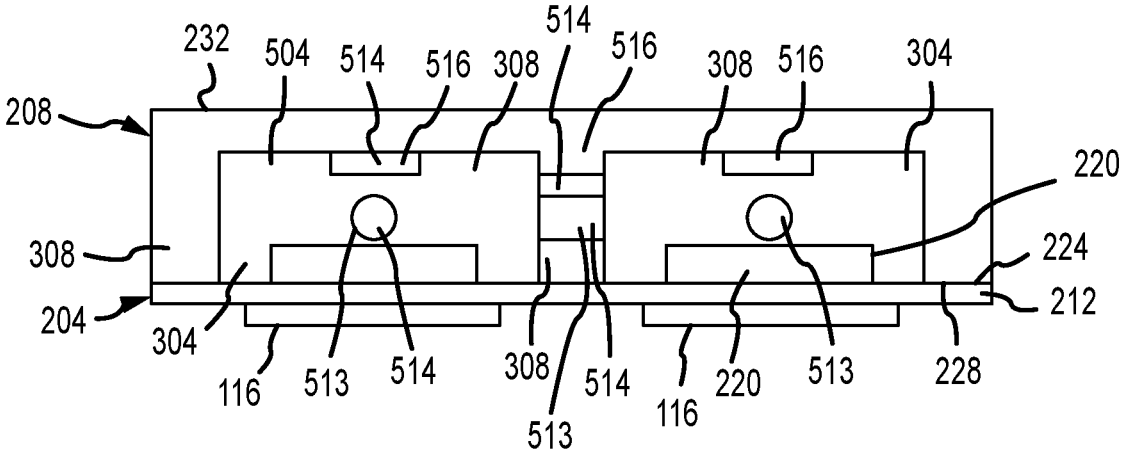
FIG. 5C is a cross-section in elevation of a portion of an antenna system incorporating an electromagnetic interference shielded heat sink in accordance with other embodiments of the present disclosure.
Figure 5D:
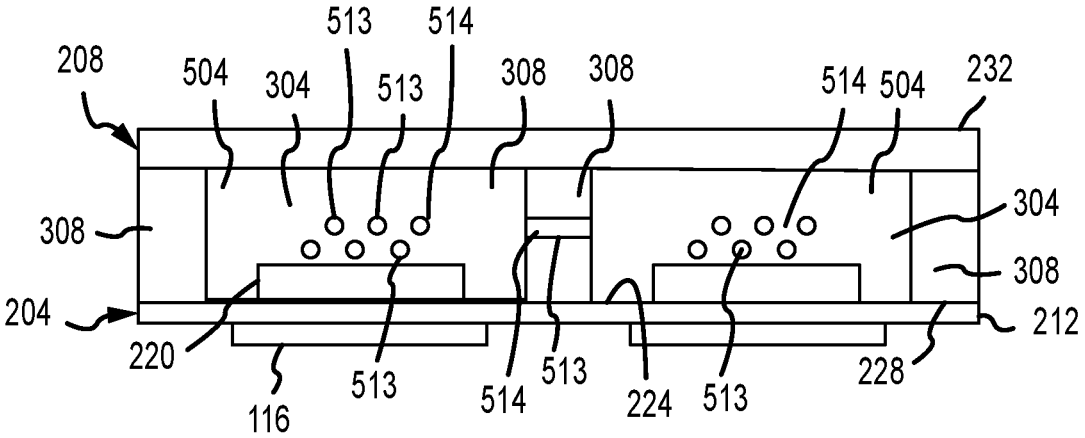
FIG. 5D is a cross-section in elevation of a portion of an antenna system incorporating an electromagnetic interference shielded heat sink in accordance with other embodiments of the present disclosure.
Figure 5E:
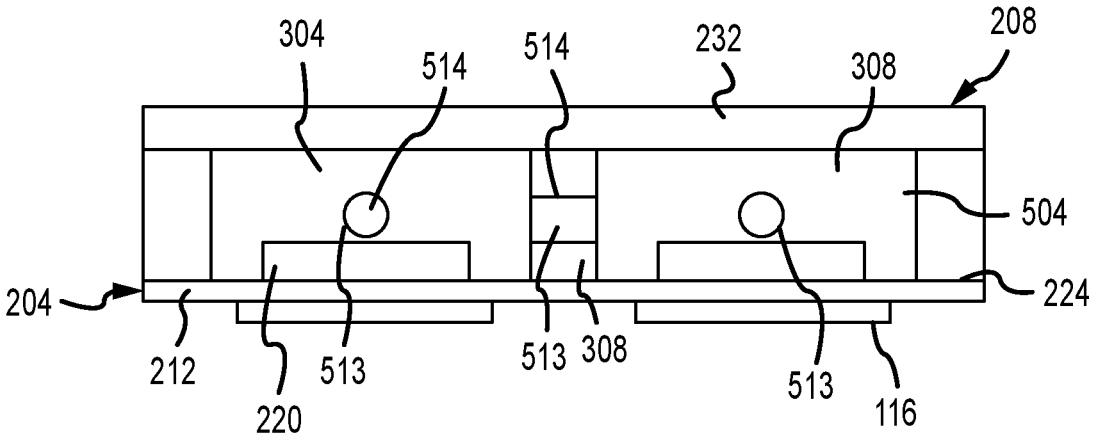
FIG. 5E is a cross-section in elevation of a portion of an antenna system incorporating an electromagnetic interference shielded heat sink in accordance with other embodiments of the present disclosure.
Figure 5F:
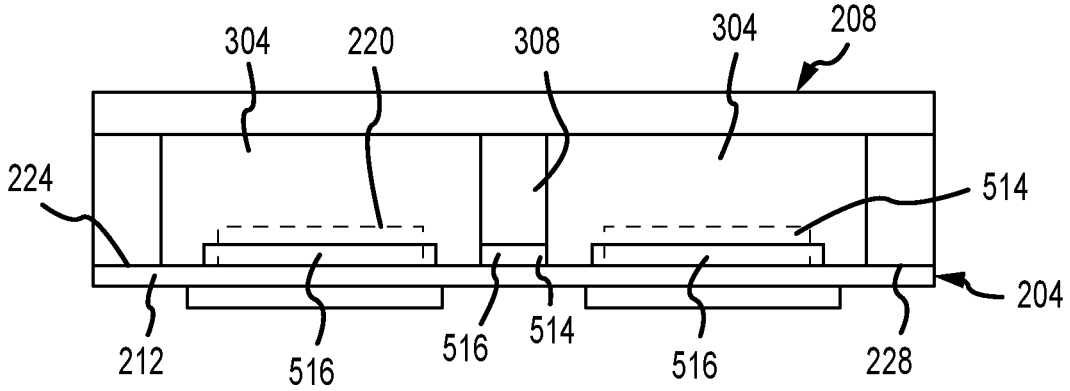
FIG. 5F is a cross-section in elevation of a portion of an antenna system incorporating an electromagnetic interference shielded heat sink in accordance with other embodiments of the present disclosure.
Figure 5G:
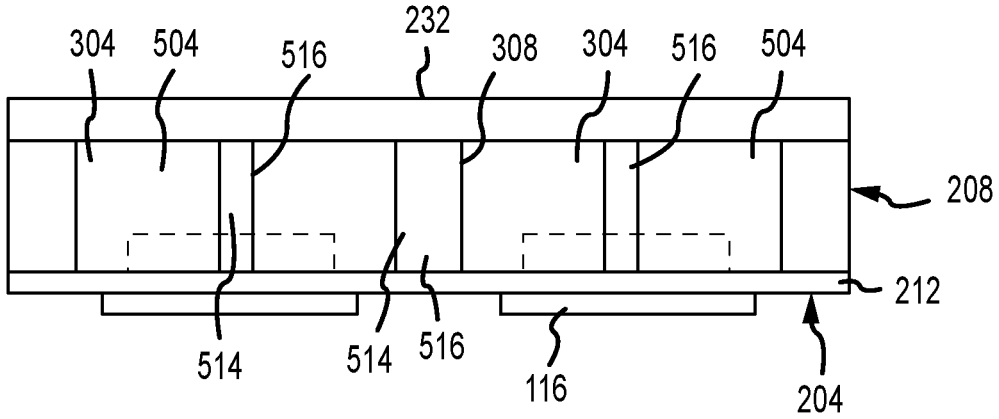
FIG. 5G is a cross-section in elevation of a portion of an antenna system incorporating an electromagnetic interference shielded heat sink in accordance with other embodiments of the present disclosure.

The volumes 504 defined by the pockets 304 in the embodiment depicted in FIG. 5A are entirely enclosed and are isolated from one another when the EMI shielded heat sink 208 is joined to the antenna board 204. However, other configurations are possible. For instance, as depicted in FIG. 5B, apertures or orifices 513 can be formed in the walls 308 of the EMI shielded heat sink 208, to define fluid flow paths 514 that allow fluid (not shown in FIG. 5B) to circulate between adjacent volumes 504. As illustrated in FIG. 5C, and in comparison to the apertures 513 shown in FIG. 5B, the apertures 513 can be of various shapes. Alternatively or in addition, fluid flow paths 514 can be configured as slots 516 that are formed along the top portions of the walls 308, again to allow fluid (not shown in FIG. 5C) to flow between adjacent volumes 504. As illustrated in FIG. 5D, walls 308 between adjacent volumes 504 can contain a plurality of apertures 513 to form fluid flow paths 514 that allow fluid (not shown in FIG. 5D) to flow between adjacent volumes 504. The example embodiment illustrated in FIG. 5E includes round apertures 513 to form fluid flow paths 514 that allow fluid (not shown in FIG. 5E) to flow between adjacent volumes 504. In the example embodiment of FIG. 5F, fluid flow paths 514 in the form of slots 516 are located in bottom edges (i.e. the edges of adjacent the second surface 224 of the antenna board 204) of the walls 308 to allow fluid (not shown in FIG. 5F) to flow between adjacent volumes 504. In FIG. 5F, the circuit elements 220 are shown with dashed lines, so as not to obscure views of the slots 516. FIG. 5G is an example in which fluid flow paths 514 configured as slots 516 formed in center portions of the walls 308 are provided to allow fluid (not shown in FIG. 5G) to flow between adjacent volumes 504. In FIG. 5G, the circuit elements 220 are shown with dashed lines, so as not to obscure views of the slots 516. In each embodiment in which flow paths 514 are formed to permit fluid 508 to flow between adjacent volumes 504, the apertures and/or slots 516 are sized so as to prevent the propagation of radiofrequency signals between the adjacent volumes 504. More particularly, the apertures 513, slots 516, or other flow paths 514 are no larger than the smallest operating wavelength of the antenna system, to maintain EMI isolation between adjacent volumes 504.

Figure 6A:
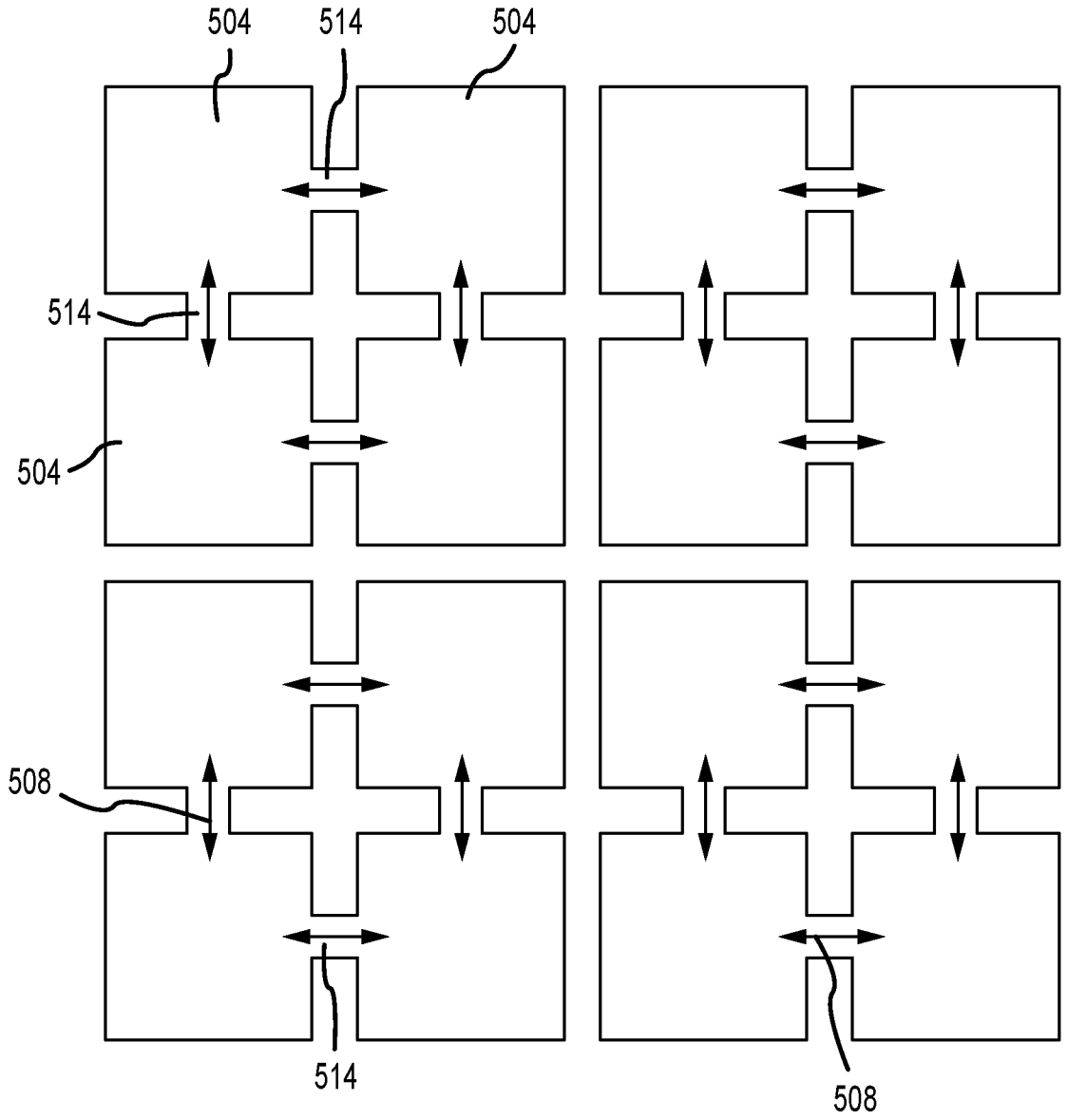
FIG. 6A depicts a flow paths through pockets of an antenna system incorporating an electromagnetic interference shielded heat sink in accordance with embodiments of the present disclosure.

FIG. 6A depicts an array of adjacent volumes 504 of an antenna system 104 incorporating an EMI shielded heat sink 208 accordance with embodiments of the present disclosure, in a plan view. In particular, flow paths 514 through volumes 504 of the antenna system 104 through which a cooling fluid 508 can flow are depicted. In this example, adjacent volumes 504 within the same subset of volumes 504 are in fluid communication with one another via fluid flow paths 514. However, adjacent volumes 504 included in different subsets are separated from one another.

Figure 6B:
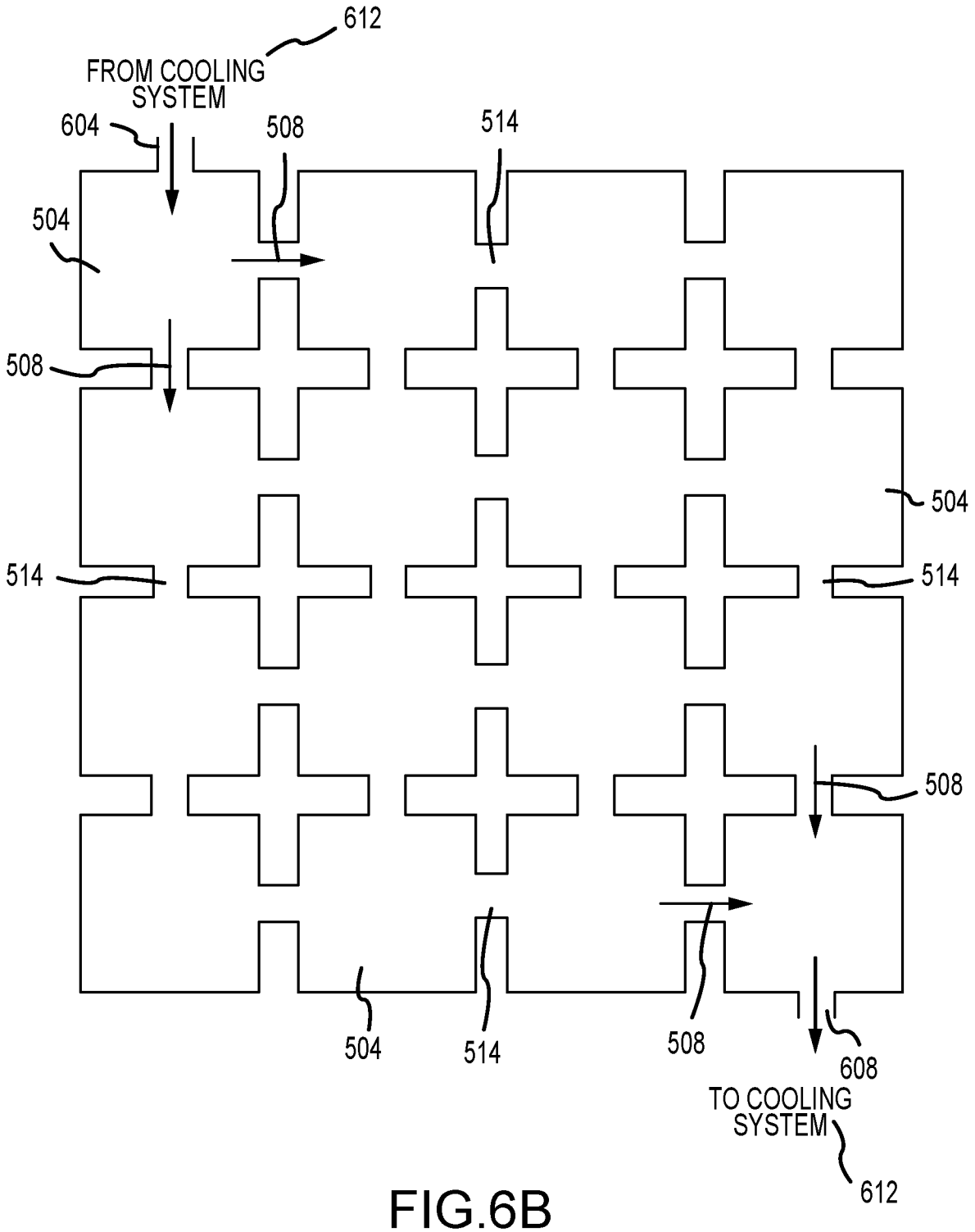
FIG. 6B depicts a flow paths through pockets of an antenna system incorporating an electromagnetic interference shielded heat sink in accordance with other embodiments of the present disclosure.

FIG. 6B depicts an array of adjacent volumes 504 of an antenna system 104 incorporating an EMI shielded heat sink 208 accordance with embodiments of the present disclosure, in a plan view, in which every volume 504 is in fluid communication with every adjacent volume 504 through fluid flow paths 514. In addition, the example shown in FIG. 6B includes an inlet 604 and an outlet 608, that can be provided to connect to the volumes 504 to a cooling system 612, such as a radiator, thermosiphon, or heat pipe loop. Alternatively, the inlet 604 and the outlet 608 can be omitted to provide a sealed array of interconnected volumes 508.

Figure 6C:
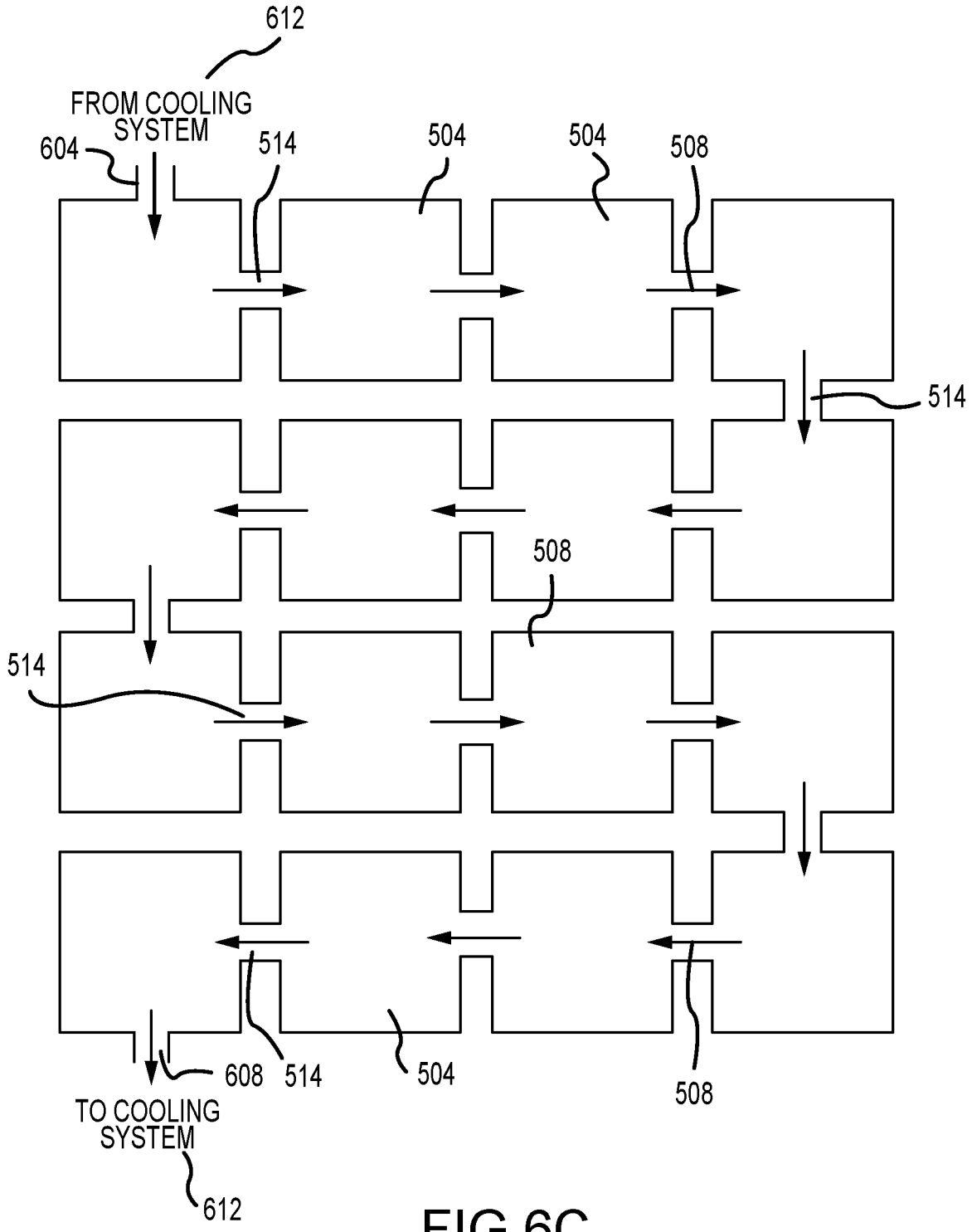
FIG. 6C depicts a flow paths through pockets of an antenna system incorporating an electromagnetic interference shielded heat sink in accordance with still other embodiments of the present disclosure.

FIG. 6C also depicts an array of adjacent volumes 504 of an antenna system 104 incorporating an EMI shielded heat sink 208 accordance with embodiments of the present disclosure, in a plan view, in which every volume 504 is in fluid communication with every adjacent volume 504 through fluid flow paths 514. However, in this example, the flow paths 514 define a circuitous flow path for cooling fluid 508 that passes through all of the volumes 504 in a constrained sequence between an inlet 604 and an outlet 608. The inlet 604 and the outlet 608 can be connected to an external cooling system 612, a pump, or both.

Figure 7:
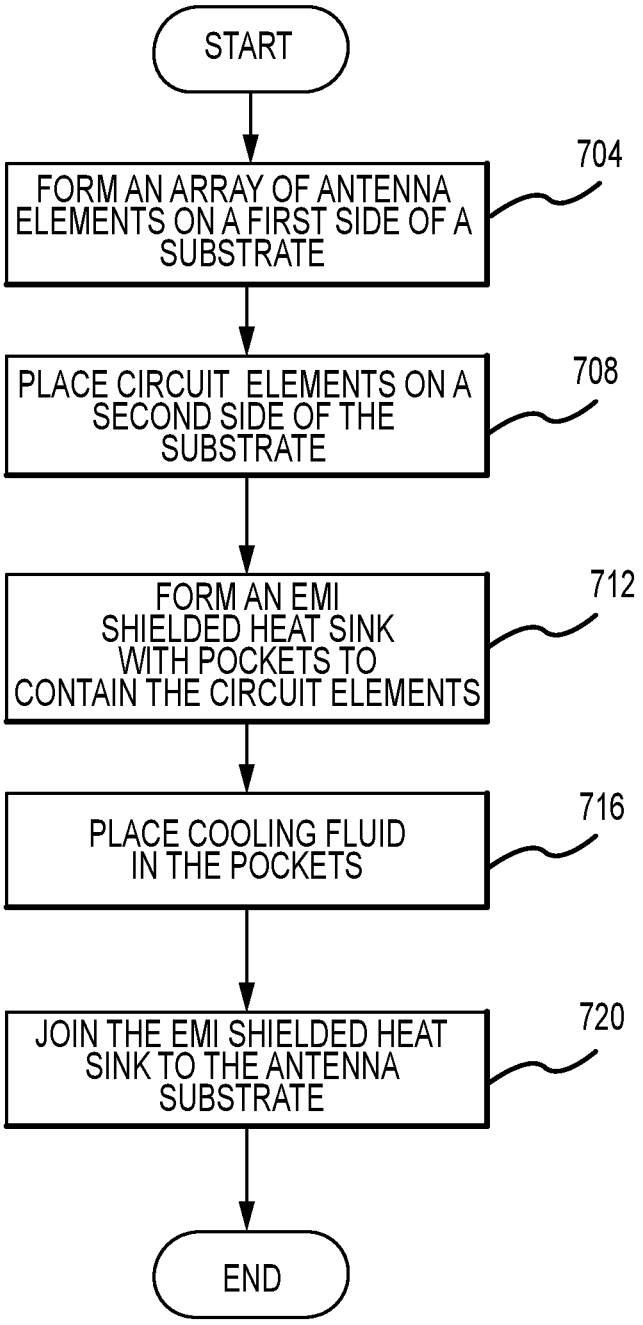
FIG. 7 is a flowchart illustrating aspects of a process for providing and operating an antenna system incorporating an electromagnetic interference shielded heat sink in accordance with embodiments of the present disclosure.

FIG. 7 is a flowchart illustrating aspects of a process for providing and operating an antenna system 104 incorporating an electromagnetic interference shielded heat sink in accordance with embodiments of the present disclosure. Initially, at step 704, an array of antenna elements 116 is formed on a first side or surface 216 of a substrate 212. As an example, but without limitation, the substrate 212 can include a multilayer printed circuit board, and forming the antenna elements 116 can include etching a metallic layer of the circuit board to form an array of antenna elements 116. As another example, and again without limitation, the antenna elements 116 can be formed by depositing or placing a metal on the first surface 216 of the substrate 212. A plurality of circuit elements 220 are formed or placed on the second surface 224 of the substrate 212 (step 708). In general, one circuit element 220 or set of circuit elements 220 are provided for each antenna element 116. Accordingly, where the antenna elements 116 are disposed in a plurality of rows and columns, the circuit elements 220 can similarly be disposed in a plurality of rows and columns. In addition, each antenna element 116 is operatively connected to the corresponding circuit element 220 or set of circuit elements 220. For example, an antenna element 116 can be electrically connected to a corresponding circuit element 220 by a via formed in the substrate 212, directly or in combination with wirings or pads formed in or on the substrate 212.

At step 712, an EMI shielded heat sink 208 having a plurality of pockets 304 to contain the circuit elements 220 is formed. More particularly, each pocket 304 is configured to contain the circuit elements 220 of a corresponding antenna element 116. Accordingly, one pocket 304 is provided for each antenna element 116, and specifically for the circuit element or elements 220 associated with each antenna element 116. As a result, the plurality of pockets 304 can be disposed in an array mirroring the array of circuit elements 220 provided for the array of antenna elements 116. Forming the pockets 304 can include providing a unitary metallic plate and milling, etching, or otherwise removing material in the areas of the pockets 304, leaving walls 308 between adjacent pockets 304. Accordingly, the components of the EMI shielded heat sink 208 can be an integral to one another. As another example, the pockets 304 can be formed by joining walls 308 to a shield portion 232 in the form of a plate. As an example, but without limitation, the EMI shielded heat sink 28 may be formed from aluminum. Optionally, flow paths 316 can be formed to interconnect some or all of the adjacent pockets 304. Forming flow paths 316 can include forming slots, notches, or apertures in at least some of the walls 308 between adjacent pockets 304.

A cooling fluid 508 can then be placed in the pockets 304 (step 716). In accordance with the least some embodiments of the present disclosure, an amount of cooling fluid 508 that entirely fills each of the pockets 304 is provided. In accordance with other embodiments of the present disclosure, the fluid 508 is provided in an amount that only partially fills each of the pockets 304 leaving a head space in which vapor can collect. The cooling fluid 508 may be a dielectric fluid. As examples, but without limitation, the cooling fluid can include water, ammonia, alcohol, mercury, sodium, and liquid helium.

At step 720, the EMI shielded heat sink 208 is joined to the antenna board 204. In particular, the second surface 224 of the antenna board 204 is joined to an inside surface 228 of the EMI shielded heat sink 208, and with the circuit elements 220 corresponding to different antenna elements 116 placed within different pockets 304 of the EMI shielded heat sink 208. The second surface 224 of the antenna board 204 and the pockets 304 thereby form closed volumes 504 containing the cooling fluid 508. Joining the EMI shielded heat sink 208 and antenna board 204 can include bonding using an adhesive applied to the EMI shielded heat sink 208 and/or the antenna board 204. Where fluid flow paths 516 are included, the cooling fluid 508 can flow between adjacent volumes 504 interconnected by the fluid flow paths 516.

As can be appreciated by one of skill me art after consideration of the present disclosure, different the various steps for forming an antenna system as disclosed herein can be performed in different orders. In addition, different process steps can be applied, and different materials can be used.

In operation, the cooling fluid 508 contacts the circuit elements 220, removing heat from those elements 220. The heat can be transferred by the cooling fluid 508 to the shield surface 232 of the EMI shielded heat sink 208 through convective cooling. The heat can then be dissipated from the shield surface 232 to the atmosphere. Alternatively or in addition, the cooling fluid 508 can be circulated through a radiator or other cooling system 612, to remove heat from the antenna system 104. In accordance with the least to some embodiments, cooling fins or features are placed or formed on a surface of the shield surface 232 opposite the surface where the pockets 304 are located. In the various embodiments, even cooling of the antenna system 104 components is promoted by the inclusion of the cooling fluid 508 in the volumes 504.

Previously, dielectric cooling for antenna systems, including phased array antenna systems, focused on thermosiphons or heat pipes. In addition, EMI shielding was provided as a separate structure or feature. Embodiments of the present disclosure do not rely on a thermosiphon or heat pump fluid action. Instead, natural convection from the dielectric fluid is integrated into the EMI shield. As a result, heat sinking and electrical isolation can both be provided by the electromagnetic interference shielded heat sink 208. In addition to providing favorable cooling and shielding effects, embodiments of the present disclosure enable an economical solution to providing cooling and EMI shielding to an antenna system.

The foregoing discussion of the disclosed systems and methods has been presented for purposes of illustration and description. Further, the description is not intended to limit the disclosed systems and methods to the forms disclosed herein. Consequently, variations and modifications commensurate with the above teachings, within the skill or knowledge of the relevant art, are within the scope of the present disclosure. The embodiments described herein are further intended to explain the best mode presently known of practicing the disclosed systems and methods, and to enable others skilled in the art to utilize the disclosed systems and methods in such or in other embodiments and with various modifications required by the particular application or use. It is intended that the appended claims be construed to include alternative embodiments to the extent permitted by the prior art.

What is claimed is:

1. An antenna system, comprising:

an antenna board, including:

a circuit board;

a plurality of antenna elements on a first surface side of the circuit board; and a plurality of circuit elements on a second surface side of the circuit board;

an electromagnetic interference shielded heat sink, including:

a cover portion; and a plurality of pockets defined by walls that extend from the cover portion, wherein a surface of the electromagnetic interference shielded heat sink corresponding to an end of the walls opposite an end adjacent to the cover portion is fixed to the second surface side of the circuit board such that the plurality of pockets, the cover portion, and the second surface side of the circuit board define a plurality of volumes, wherein each volume in the plurality of volumes contains at least one circuit element included in the plurality of circuit elements and a cooling fluid, and wherein, for each volume in the plurality of volumes, the cooling fluid contained therein is in contact with a surface of the at least one circuit element also contained therein, the cooling fluid contained therein is in contact with at least a portion of a surface of each of the walls of the volume, the cooling fluid contained therein is in contact with at least a portion of a surface of the cover portion, and the cooling fluid contained therein is in contact with at least a portion of the second surface of the circuit board.

2. The antenna system of claim 1, wherein antenna elements included in the plurality of antenna elements are disposed in a planar array.

3. The antenna system of claim 1, wherein volumes included in the plurality of volumes are sealed.

4. The antenna system of claim 1, wherein the cooling fluid entirely fills at least some volumes included in the plurality of volumes.

5. The antenna system of claim 1, wherein the cooling fluid partially fills at least some volumes included in the plurality of volumes.

6. The antenna system of claim 1, further comprising:

a plurality of fluid flow paths interconnecting adjacent volumes included in the plurality of volumes.

7. The antenna system of claim 6, wherein fluid flow paths included in the plurality of fluid flow paths are apertures in walls between at least some of the adjacent volumes.

8. The antenna system of claim 6, wherein fluid flow paths included in the plurality of fluid flow paths are slots in walls between at least some of the adjacent volumes.

9. The antenna system of claim 1, wherein pockets included in the plurality of pockets are defined by walls on an interior surface side of the electromagnetic interference shielded heat sink.

10. The antenna system of claim 9, wherein the cover portion includes cooling fins formed on an outside surface side of the electromagnetic interference shielded heat sink.

11. The antenna system of claim 1, wherein the cooling fluid is a dielectric fluid.

12. The antenna system of claim 11, wherein the electromagnetic interference shielded heat sink is formed from a metallic material.

13. The antenna system of claim 11, wherein the antenna system is a phased array antenna system.

14. The antenna system of claim 6, wherein the antenna system is provided as part of a 5G communications system.

15. An antenna system, comprising:

a substrate;

a plurality of antenna elements on a first surface of an antenna board;

a plurality of circuit elements on a second surface of the antenna board, wherein at least one circuit element is provided for each antenna element in the plurality of antenna elements, wherein each antenna element in the plurality of antenna elements is interconnected to a corresponding circuit element included in the plurality of the circuit elements;

an electromagnetic shielded heat sink, wherein a plurality of pockets are defined by walls extending from a shield portion of the electromagnetic shielded heat sink, wherein one pocket is provided to correspond to a circuit element for each antenna element in the plurality of antenna elements, wherein an interior surface of the electromagnetic shielded heat sink defined by ends of the walls is joined to the second surface of the antenna board, and wherein each pocket in the plurality of pockets and the second surface of the antenna board form a volume containing the circuit element corresponding to an antenna element; and a cooling fluid, wherein each volume contains some of the cooling fluid, wherein the cooling fluid in each volume is in contact with the circuit element contained therein and a portion of the second surface of the antenna board contained therein.

16. The antenna system of claim 15, further comprising:

a plurality of flow paths, wherein flow paths included in the plurality of flow paths place some adjacent volumes in fluid communication with one another.

17. The antenna system of claim 16, further comprising:

a cooling system;

an inlet, wherein the inlet is in fluid communication with the volumes and with the cooling system; and an outlet, wherein the outlet is in fluid communication with the volumes and with the cooling system.

18. The antenna system of claim 11, wherein, in a plan view taken along a line perpendicular to the first side of the circuit board, at least a portion of each antenna element in the plurality of antenna elements overlaps at least a portion of at least one circuit element in the plurality of circuit elements.

19. The antenna system of claim 11, wherein the cover portion does not include any fluid flow paths.

* * * * *